US009248999B2

(12) United States Patent
Xydias

(10) Patent No.: US 9,248,999 B2
(45) Date of Patent: Feb. 2, 2016

(54) LEVEL WIND ARM FOR A WINCH ASSEMBLY

(76) Inventor: Harry Xydias, Plympton (AU)

( * ) Notice: Subject to any disclaimer, the term of this patent is extended or adjusted under 35 U.S.C. 154(b) by 279 days.

(21) Appl. No.: 13/497,821

(22) PCT Filed: Sep. 24, 2010

(86) PCT No.: PCT/AU2010/001258
§ 371 (c)(1),
(2), (4) Date: Mar. 23, 2012

(87) PCT Pub. No.: WO2011/035388
PCT Pub. Date: Mar. 31, 2011

(65) Prior Publication Data

US 2012/0175576 A1 Jul. 12, 2012

(30) Foreign Application Priority Data

Sep. 25, 2009 (AU) ..... 2009904669

(51) Int. Cl.
*B66D 1/36* (2006.01)
*B66D 1/38* (2006.01)

(52) U.S. Cl.
CPC .. *B66D 1/38* (2013.01); *B66D 1/36* (2013.01); *B66D 2700/0191* (2013.01)

(58) Field of Classification Search
CPC ..... B66D 1/36; B66D 3/04; B66D 1/00; B66D 1/38; B66C 5/025
USPC ..... 254/334–336, 383, 385
See application file for complete search history.

(56) References Cited

U.S. PATENT DOCUMENTS 190,811 A * 5/1877 Bevelander ..... 242/397.2
227,743 A 5/1888 Donnelly
(Continued)

FOREIGN PATENT DOCUMENTS

AU 2007202072 B1 12/2007
CH 666472 A5 7/1988
(Continued)

OTHER PUBLICATIONS

AU 2007202072 B1, Dec. 2007, Xydias H (Specifications).*
(Continued)

*Primary Examiner* — Emmanuel M Marcelo
*Assistant Examiner* — Michael Gallion
(74) *Attorney, Agent, or Firm* — Bio Intellectual Property Services LLC (Bio IPS); O. (Sam) Zaghmout

(57) ABSTRACT

The present invention relates to an improved level wind arm for a winch drum assembly, and a winch drum assembly incorporating such a level wind arm. The level wind arm includes a cross member adapted to bias against an outwardly extending portion of rope, the cross member being concave so that more force is required for the rope spindle associated with the cross member to "climb" the slope of the cross member, causing a momentary pause in motion of the spindle after it reaches the end of wind stroke. This momentary pause allows for rope being wound onto the drum to rise up the end wall of the drum to create a new layer which is aligned and consistent with the layer below, without causing gaps in the rope or other circumstances which could lead to the rope accumulating at any one point, or becoming tangled. The present invention also includes means of ensuring that tension is maintained in the rope, and that the rope does not jump off the reel and, for example, into the clutch mechanism.

18 Claims, 6 Drawing Sheets

(56) References Cited

U.S. PATENT DOCUMENTS

| | | | | | |
|---|---|---|---|---|---|
| 1,615,161 | A | * | 1/1927 | Bouvier | 242/157.1 |
| 1,973,446 | A | * | 9/1934 | Resenquist | 242/483 |
| RE20,191 | E | * | 12/1936 | Mathey et al. | 102/313 |
| 2,249,117 | A | * | 7/1941 | Crandall | 242/157.1 |
| 2,348,987 | A | * | 5/1944 | Lock | 242/157.1 |
| 2,473,628 | A | * | 6/1949 | Allison | 242/157.1 |
| 2,483,688 | A | * | 10/1949 | Brown | 242/397.3 |
| 2,595,655 | A | * | 5/1952 | Hannay | 242/390 |
| 2,660,382 | A | * | 11/1953 | Wilson | 242/478.2 |
| 2,662,703 | A | * | 12/1953 | Brown | 242/397.3 |
| 2,904,284 | A | * | 9/1959 | Newsom | 242/397.3 |
| 2,922,599 | A | * | 1/1960 | Bigelow | 242/484.2 |
| 3,078,060 | A | * | 2/1963 | Le Bus, Sr. | 242/157.1 |
| 3,687,385 | A | * | 8/1972 | Skalleberg | 242/470 |
| 3,892,386 | A | * | 7/1975 | Hogan | 254/390 |
| 3,946,991 | A | * | 3/1976 | Eriksson | 254/323 |
| 4,015,798 | A | * | 4/1977 | Benya | 242/157.1 |
| 4,204,354 | A | * | 5/1980 | Kane | 43/4.5 |
| 4,455,961 | A | * | 6/1984 | Hansen et al. | 114/254 |
| 4,744,696 | A | * | 5/1988 | Vidler | 405/180 |
| 4,778,121 | A | * | 10/1988 | Minnee | 242/157.1 |
| 5,002,238 | A | | 3/1991 | Inhofer | |
| 5,139,751 | A | * | 8/1992 | Mansfield et al. | 422/292 |
| 5,330,122 | A | * | 7/1994 | Wood | 242/481.3 |
| 5,427,327 | A | * | 6/1995 | Anderson et al. | 242/362 |
| 5,829,737 | A | * | 11/1998 | Gersemsky | 254/278 |
| 6,435,447 | B1 | * | 8/2002 | Coats et al. | 242/483 |
| 6,443,431 | B1 | * | 9/2002 | Stasny et al. | 254/385 |
| 6,494,437 | B1 | * | 12/2002 | Boyer | 254/323 |
| 6,811,112 | B1 | * | 11/2004 | Currie et al. | 242/534.1 |
| 6,910,679 | B1 | * | 6/2005 | Vogt et al. | 254/385 |
| 7,111,803 | B2 | * | 9/2006 | Mott et al. | 242/397.4 |
| 7,419,137 | B2 | * | 9/2008 | Boon | 254/323 |
| 7,621,508 | B2 | * | 11/2009 | Wagner et al. | 254/372 |
| 8,267,379 | B2 | * | 9/2012 | Yang et al. | 254/336 |
| 2001/0008279 | A1 | * | 7/2001 | Kiviniitty | 254/335 |
| 2005/0087644 | A1 | * | 4/2005 | Kim | 242/390.8 |
| 2006/0144986 | A1 | * | 7/2006 | Tsai | 242/397.2 |
| 2012/0048152 | A1 | * | 3/2012 | Kim et al. | 108/20 |

FOREIGN PATENT DOCUMENTS

| | | | | |
|---|---|---|---|---|
| FR | 2711632 | A1 | | 5/1995 |
| JP | S52102672 | | | 8/1977 |
| JP | S6056685 | | | 4/1985 |
| JP | S62 34590 | U | | 2/1987 |
| JP | 2007191233 | A | * | 8/2007 |
| SU | 1518275 | | | 10/1989 |
| WO | WO2006/117607 | | | 11/2006 |

OTHER PUBLICATIONS

AU 2007202072 B1, Dec. 2007, Xydias H (Drawings).*

* cited by examiner

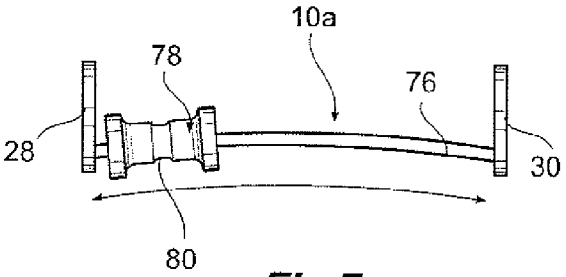
Fig 7
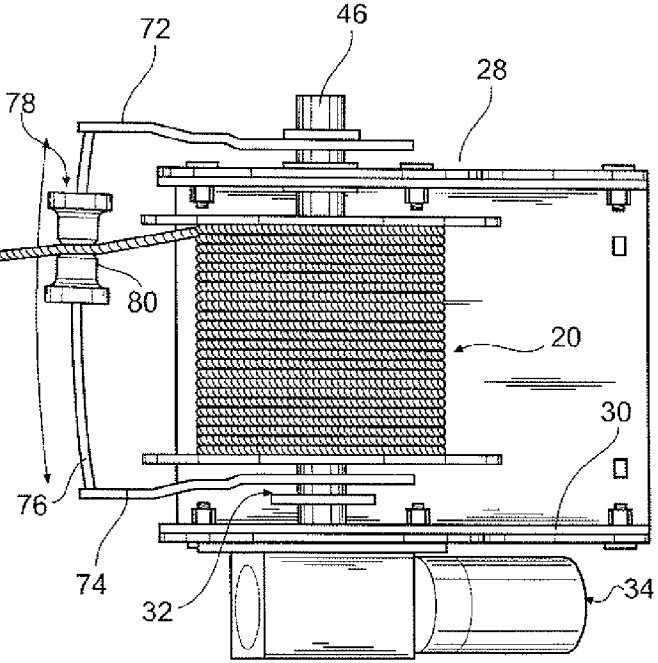
Fig 8
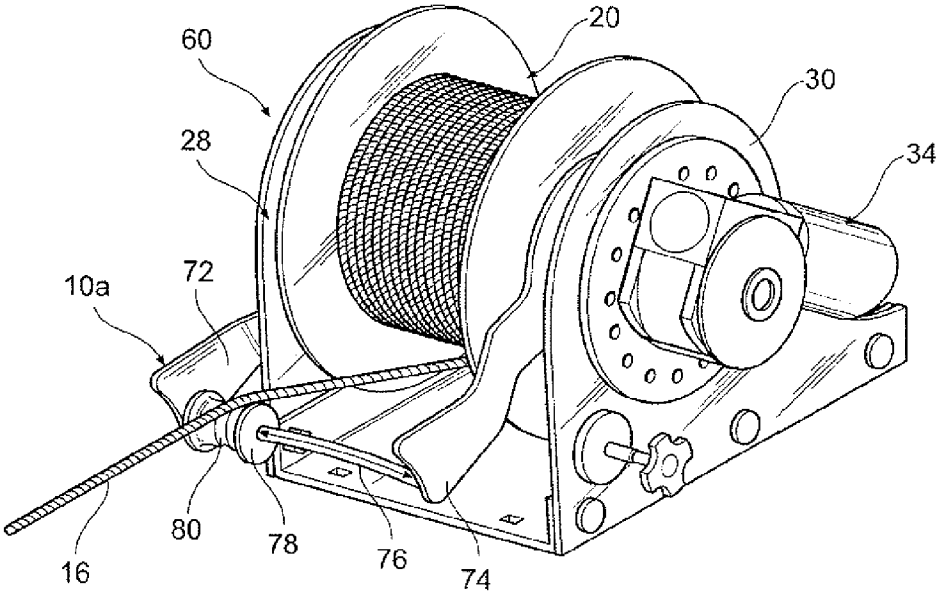
Fig 6
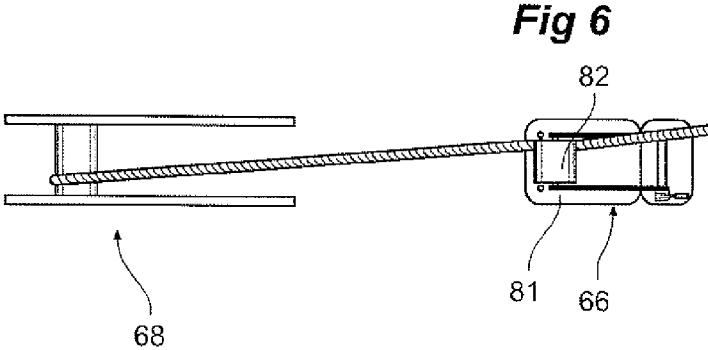

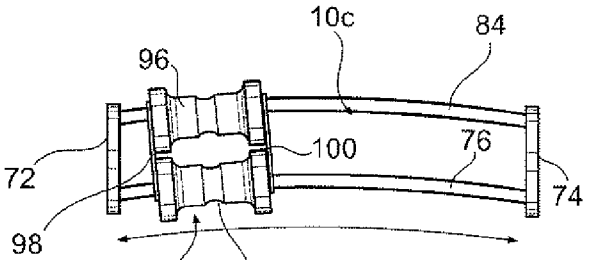
Fig 13
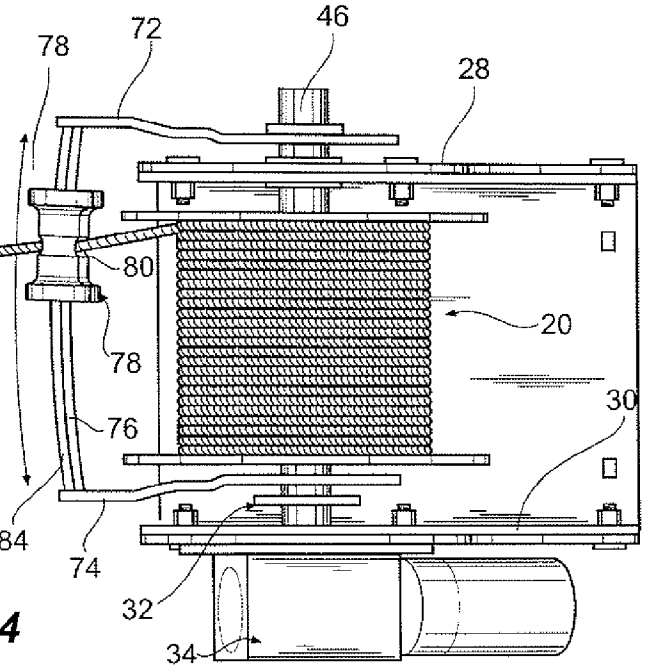
Fig 14
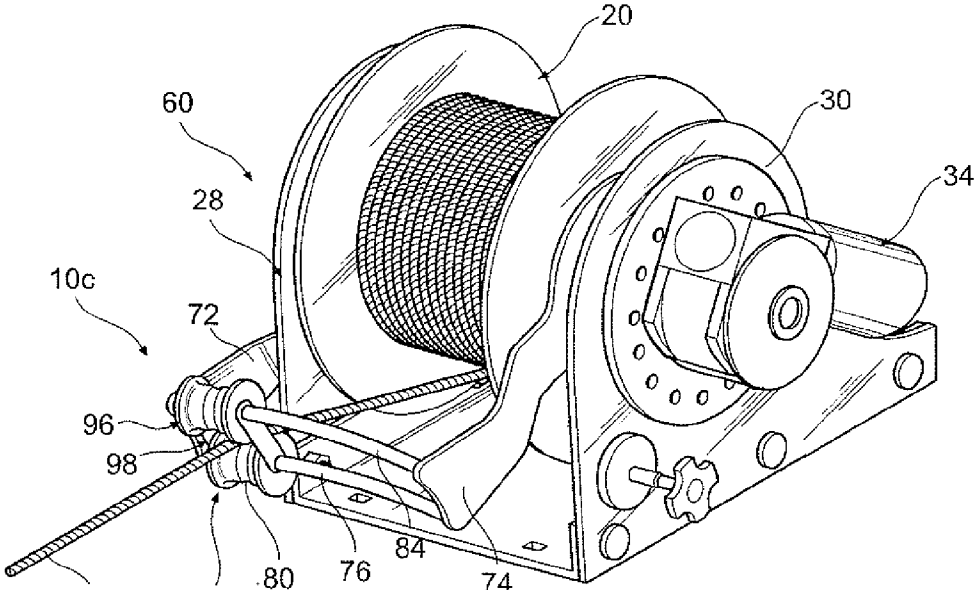
Fig 12
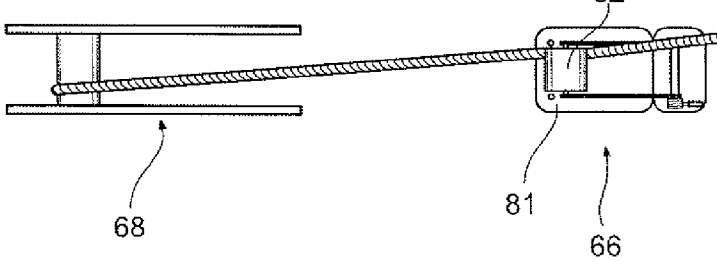

LEVEL WIND ARM FOR A WINCH ASSEMBLY

The present invention relates to an improved level wind arm for a winch assembly and, in particular, to a level wind arm configured to cause a level wind arm spindle to pause momentarily at each end of a stroke to thereby ensure that rope (or chain, cable or the like) loops around the drum wheel twice adjacent the reel drum walls. This ensures a faultless level wind of the rope about the drum reel without gaps or undesirable accumulation at any one point. The invention also relates to a winch assembly incorporating the level wind arm.

BACKGROUND OF THE INVENTION

It is to be understood that reference to a winch reel herein is the typically cylindrical portion of the winch drum assembly about which rope or other similar rope-like material is wound. Further, although the present invention relates generally to boat winches, it should not be limited to such usage. For example, the winch assembly could equally well be used in other similar applications which require the level winding of a rope onto a winch reel. It is to be still further understood that any use of the word "rope" herein may incorporate within its meaning, chains, wire, cord, cables and any other rope-like material which could be wound around the reel.

Winches are well known devices used on boats for raising and descending anchors. The anchor is connected to a rope or chain which is wound around a reel portion of a winch drum, which is typically powered by a motor for raising and/or descending the anchor. The winch drum is usually positioned a short distance rearward from the front of the boat and the rope is guided by rollers typically positioned on the front deck.

A problem with existing boat winches is that during raising of the anchor, the rope does not level wind, that is, it tends to accumulate at the centre of the winch drum or climb up the opposed side walls of the drum. Accumulation of the rope may result in jerky movement during descent of the anchor, damage to the rope, and in some instances may even prevent the anchor from descending due to excessive tangling. In assemblies where the winch drum rotates through the reduction gearing of the motor, such jerky movements during descent may result in damage to the motor and other parts of the assembly.

In addition, there may be circumstances, particularly in winch drums which have the capacity to free fall, in which proper contact between the rope and drum reel is not achieved, presenting a further situation for damage to the rope and snarling or tangling of the same.

The present inventor is the owner of Australian Letters Patent No. 2007202072 relating to a level wind arm associated with a winch drum assembly which overcomes at least some of the abovementioned problems, and is incorporated by reference herein. The level wind arm includes a cross member which extends substantially parallel to the axle of the winch drum. The spindle is rotatable about the cross member to accommodate forward and backward movement of the rope, and also slideable along the cross member to allow for movement of the rope as it is wound or unwound from the drum.

The cross member is biased and exerts a downward pressure (or upward pressure if the rope extends above the spindle) on the rope a short distance from the drum to ensure that rope is wound or unwound about the drum under tension, and in a level and controlled manner. For a more detailed description of this prior art level wind arm, the reader is referred to the detailed description below in relation to FIGS. 1 and 2 which illustrate the prior art level wind arm.

Although this level wind arm has proven to be effective, a problem has been identified by the present inventor when rope is being wound onto the drum. By the time the rope approaches the end of the reel, and rises up to form a new layer above, the spindle has already started its journey back along the cross member. This causes the new layer of rope to lose consistency with the layer below, and hence gaps can form adjacent the ends of the reel. Once again, this can result in tangling and accumulation. When more rope is wound and further layers are formed, this problem is exacerbated.

It is therefore an object of the present invention to overcome at least some of the aforementioned problems or to provide the public with a useful alternative.

SUMMARY OF THE INVENTION

Therefore in one form of the invention there is proposed a level wind arm for a winch drum assembly including a winch drum reel, said level wind arm characterised by:

a first cross member;

a spindle rotatably associated with said first cross member and slideable therealong, said spindle include receiving means which rotatably contacts a tether extending outwardly from said winch assembly, said first cross member adapted to bias against said tether to facilitate level winding of said tether about said winch drum reel; and wherein said first cross member includes a vertical component causing said spindle to pause momentarily at the end of each stroke, thereby facilitating the consistent formation of layers about the winch drum.

Preferably said level wind arm includes a second cross member disposed above said first cross member.

In preference said second cross member includes a bracket associated therewith, said bracket slideably engaging both first and second cross members and including flange portions between which said spindle is disposed, wherein movement of said spindle along said first cross member causes said bracket to move along said second cross member.

In preference said bracket defines a perimeter for said tether, thereby preventing said tether from jumping off said winch drum reel.

Preferably said second cross member includes a second spindle associated therewith, said second spindle being rotatably associated with said second cross member and slideable therealong, said first and second spindles adapted to move in formation along the respective cross members through use of connecting rods on opposed ends of the spindles including apertures which slideably engage said cross members.

In preference said first and second spindles define a perimeter for said tether, thereby preventing said tether from jumping off said winch drum reel.

In a further form of the invention there is proposed a winch assembly characterised by:

a reel rotatable about a central axis of rotation;

a tether adapted to be wound about said reel when rotated in a first direction and unwound from said reel when rotated in the opposite direction, said tether including a portion that extends outwardly from said reel to a distal location under tension from a load;

a level wind arm including a spindle adapted to rotatably engage said tether, said wind arm being biased against the outwardly extending portion of tether at a point between said reel and said distal location, such force facilitating level winding and unwinding of said tether about said reel; and wherein said level wind arm includes a vertical component at ends thereof which causes said spindle to pause momentarily at the end of each wind stroke, thereby facilitating the consistent formation of layers about the winch drum.

Preferably said level wind arm is rotatable about said central axis of rotation.

In preference said level wind arm is disposed a short distance from the reel in a relationship whereby said arm extends across the outwardly extending portion of tether.

In preference said level wind arm is of substantially the same length as the length of the reel.

Preferably said reel includes a fixed frame, and said level wind arm is supported between two rotatably biased support arms located on either side of the reel and mounted to said frame.

Preferably said reel is rotatable through operation of a drive means.

In preference said drive means is in the form of an electric motor capable of forward and reverse drive.

Preferably said tether is a rope, chain, cable or similar material capable of withstanding high tensile loads.

In a still further form of the invention there is proposed a winch assembly for raising and lowering a boat anchor, said winch assembly characterised by:

a rotatable reel having a central axis of rotation;

a predetermined length of tether including a first portion which is wound about said reel and a second portion extending outwardly therefrom to a distal location, said second portion being tensioned by the weight of the attached anchor;

a level wind arm being rotatably biased against the second tether portion at a point between the reel and said distal location, such force facilitating level winding and unwinding of said tether about said reel; and wherein said level wind arm includes a vertical component at ends thereof which causes said spindle to pause momentarily at the end of each wind stroke, thereby facilitating the consistent formation of layers about the winch drum.

Preferably said level wind arm is rotatable about said central axis of rotation.

In preference said distal location is in the form a guide roller fixed to said boat, used to facilitate movement of said tether in a direction perpendicular to the reel central axis of rotation.

Preferably said distal location is in the form of a tensioning assembly adapted to prevent said tether from moving in a direction back towards said reel unless said reel is operated, and further adapted to allow said tether to move out from said reel by the weight of the anchor.

In preference said tensioning assembly includes a biased roller adapted to bias down against said tether.

Preferably reel is rotatable through operation of a drive means.

In preference said drive means is an electric motor capable of forward and reverse drive.

In preference said tether is a rope, chain, cable or similar material capable of withstanding a tensile load caused by the weight of said anchor.

In a still further embodiment there is proposed a tensioning assembly for use in association with a winch drum, said tensioning assembly characterised by:

a base disposed a spaced apart distance from said winch drum; and a biased roller associated with said base such that rope extending out from said winch drum extends between the base and the biased roller, said biased roller being configured such that it does not significantly affect release of the rope from the winch drum, but prevents rope extending from the winch drum to the tensioning assembly from losing tension until such time that a pulling force is applied in the direction of the winch drum sufficient to counteract said bias and allow for movement of the rope.

Preferably operation of the winch drum to wind rope thereabout constitutes said sufficient pulling force.

In preference said biased roller is pivotably associated with said base in a direction downwardly and outwardly from the winch drum.

BRIEF DESCRIPTION OF THE DRAWINGS

The accompanying drawings, which are incorporated in and constitute a part of this specification, illustrate an implementation of the invention and, together with the description, serve to explain the advantages and principles of the invention. In the drawings:

FIG. 6 illustrates a perspective view of the winch assembly of FIG. 3 or FIG. 4 including an improved level wind arm in accordance with a first embodiment of the present invention;

FIG. 7 illustrates an enlarged front view of the level wind arm of the winch assembly of FIG. 6;

FIG. 8 illustrates a top view of the winch assembly of FIG. 6 including a tensioning assembly and roller;

FIG. 12 illustrates a perspective view of the winch assembly of FIG. 3 or FIG. 4 including an improved level wind arm in accordance with a third, preferred embodiment of the present invention;

FIG. 13 illustrates an enlarged front view of the level wind arm of the winch assembly of FIG. 12; and FIG. 14 illustrates a top view of the winch assembly of FIG. 12 including a tensioning assembly and roller.

DESCRIPTION OF THE PREFERRED EMBODIMENTS

Figure 2:
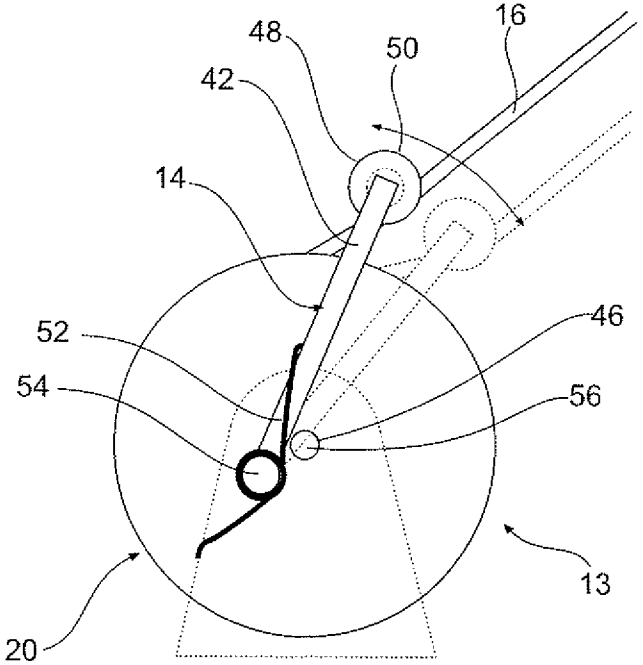
Fig 2 (PRIOR ART)
FIG. 2 illustrates a side view of the prior art winch assembly of FIG. 1.

The following detailed description of the invention refers to the accompanying drawings. Although the description includes exemplary embodiments, other embodiments are possible, and changes may be made to the embodiments described without departing from the spirit and scope of the invention. Wherever possible, the same reference numbers will be used throughout the drawings and the following description to refer to the same and like parts.

The present invention relates to an improved level wind arm 10*a*/10*b*/10*c* for a winch assembly 12 for use on a boat. Before describing the level wind arm 10 and winch assembly 12 of the present invention in more detail, it is useful to first describe the prior art assembly 13 shown in FIGS. 1 and 2.

The prior art winch drum assembly 13 includes a horizontal, biased arm 14 adapted to ensure level winding of rope 16 around a winch drum reel of a winch drum 20. An anchor (not shown) is attached at a free end of the rope 16. Two guide rollers (not shown) are used to guide rope 16 extending between the winch drum 20 and the anchor. The biased arm 14 is used to exert a force on the rope between the winch drum 20 and the first guide roller and thereby ensure level winding of the rope about the winch drum reel during raising of the anchor.

Figure 1:
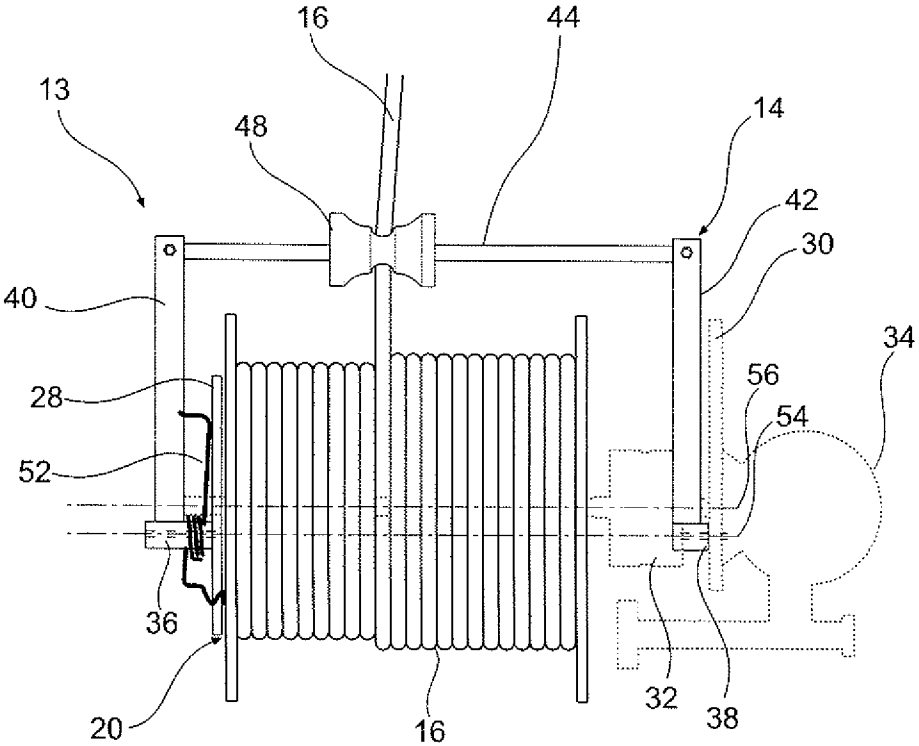
Fig 1 (PRIOR ART)
FIG. 1 illustrates a top view of a prior art winch assembly including a level wind arm.

The winch drum 20 is supported horizontally above a mounting plate (not shown) which has two side walls 28 and 30 extending upwardly on opposed sides of the winch drum 20. Therefore, when viewing the assembly from above (as shown in FIG. 1) it can be appreciated that the winch drum 20 is spaced closer to the side wall 28 on the left hand side to thereby allow space for a clutch mechanism 32 between the winch drum 20 and side wall 30. A motor 34, typically a DC motor, is mounted to the right hand side wall 30 on a right side thereof.

The way in which the motor 34, clutch mechanism 32 and winch drum 20 interact is the subject of a further Australian Letters Patent owned by the present inventor.

The level wind arm 14 is housed between the two side walls 28 and 30 located on either side of the winch drum 28. In particular, two mounting rods 36 and 38 are connected, preferably by a weld, to the walls 28 and 30 respectively, to which two forwardly extending arms 40 and 42 are pivotably attached. The two arms 40 and 42 are connected at their free ends by a cross member 44 which extends parallel to the axle 46 of the winch drum 20. The cross member 44 includes a spindle 48 connected thereto, having an outer annular groove 50 for accommodating the rope 16 which extends there beneath, or there above, whichever the case may be.

In order to accommodate for different movements of the rope 16, the spindle 48 is moveable with respect to the cross member 44. In particular, the spindle 48 is rotatable to accommodate forward and backward movement of the rope 16, and is also slideable along the cross member 44 to allow for back and forth movement of the rope as layers are wound onto or unwound from the winch drum 20. In use, when the anchor is free falling for example, the spindle will move from left to right along the cross member at substantially the same speed throughout the fall.

The cross member 44 exerts a downward force on the rope 16 through use of a spring 52 which, in this embodiment, is shown attached to mounting rod 36. The present inventor found that the rope 16 can be wound around the reel 18 in a level and controlled manner by applying a downward force against the rope 16 a short distance in front of the winch drum 20. Without such a mechanism in place, the rope 16 would extend tangentially from the drum 20 directly to the guide roller which results in accumulation of rope typically at the centre portion of the reel 18, as occurs commonly in prior art assemblies.

Therefore, rather than extending directly to the guide roller 24, the rope 16 is pushed down (or up depending on the configuration) by force exerted by arm 14 and subsequently extends up to the roller 24. With the biasing arm 14 acting against the rope 16 in relatively close proximity to the winch drum 20, it was found that movement of the rope 16 is more controlled in that it moves back and forth from one side of the drum 20 to the other forming uniform layers across the reel 18. The spindle 48, being rotatable and slideably moveable along the cross member 44, allows for such movement.

The spring 52 is not tensioned to a point where winding of the rope around the spindle 18 becomes difficult, nor is it tensioned too lightly in which case the mechanism becomes ineffective. As shown in FIG. 2, the arm 14 is biased to an extent whereby slight oscillation about pivot point 54 is allowed. The axis 54 about which the arms 40 and 42 pivot is spaced apart from the axis 56 of rotation of the winch drum 20.

As mentioned in the preamble of the invention, this prior art level wind arm assembly has deficiencies in that when rope is being wound onto the drum, and reaches the end of a stroke, by the time it has a chance to rise up to form a new layer, the spindle has already started its journey back along the cross member. This causes inconsistencies between the layers and hence gaps, and a faultless level winding of the rope is not achieved.

Turning now to the features of the present invention, it is to be understood that like parts between the prior art assembly of FIGS. 1-2 and the present invention will be referred to using like reference numerals.

Figure 3:
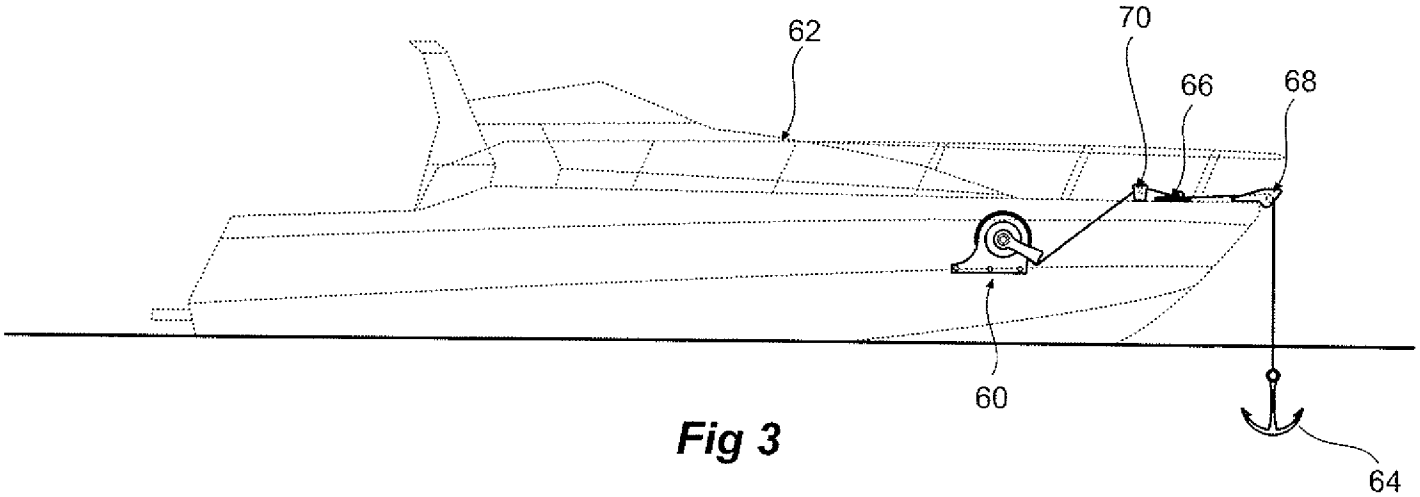
FIG. 3 illustrates a side view of a marine vessel including a winch drum assembly positioned below the front deck of the vessel, the winch drum assembly including a level wind arm of the present invention.
Figure 4:
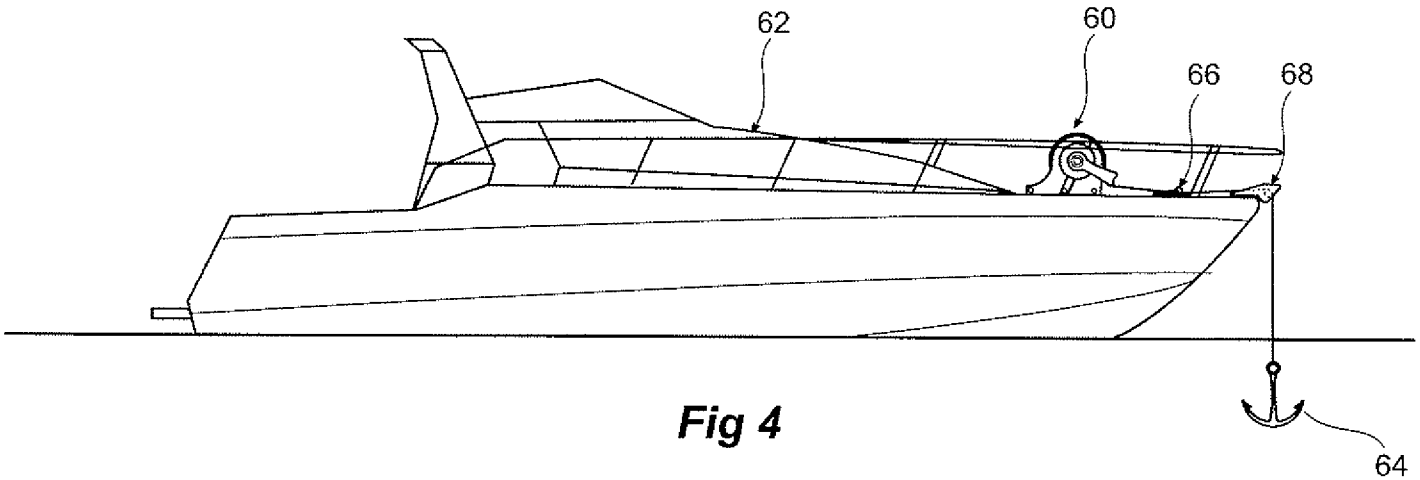
FIG. 4 illustrates a side view of a marine vessel including a winch drum assembly positioned above the front deck of the vessel, the winch drum assembly including a level wind arm of the present invention.
Figure 5:
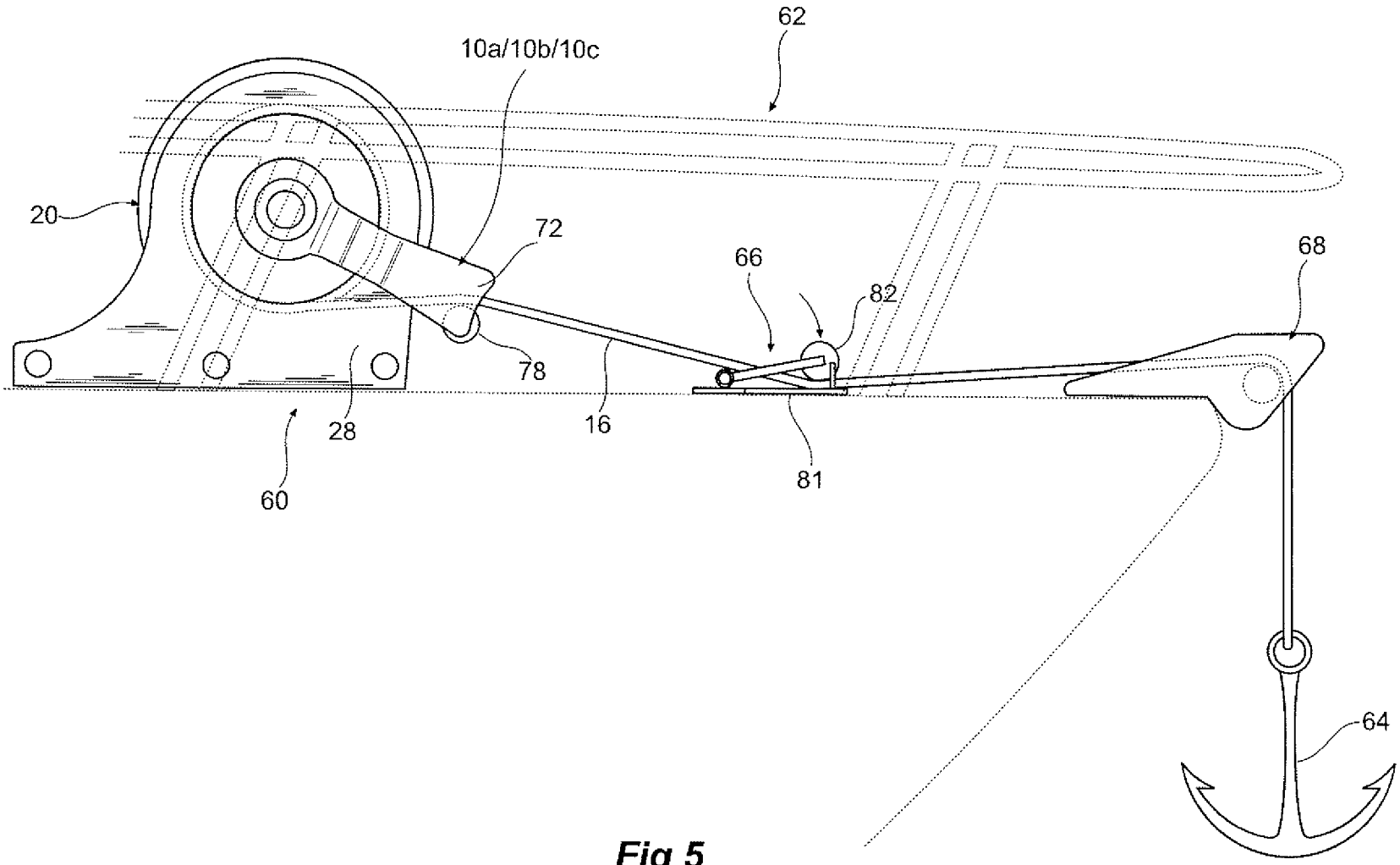
FIG. 5 illustrates an enlarged side view of the winch assembly, tensioning assembly, and roller of the marine vessel of FIG. 4.

FIG. 3 illustrates a winch drum assembly 60 including a level wind arm 10*a*/10*b*/10*c* embodied in the present invention, positioned below the front deck of a marine vessel 62, and FIG. 4 illustrates the winch drum assembly 60 positioned above the deck. In both situations, the rope 16 extends between the drum reel 20 and an anchor 64, via a tensioning assembly 66 and guide roller 68 positioned on the deck. The tensioning assembly 66 of the present invention is shown more clearly in FIG. 5 and will be described in more detail below. The purpose of the guide roller 68 is known in the art so will not be described further. When positioned below the deck, there is a further guide assembly 70 positioned above the deck between the winch assembly 60 and the tensioning assembly 66. The guide assembly 70 and its purpose will also be described in more detail below.

The winch drum assembly 60 including an improved level wind arm 10*a* in accordance with a first embodiment of the invention is shown in FIG. 6. The level wind arm 10*a* includes two arms 72 and 74 which are pivotable about the drive shaft axle 46. The arms 72 and 74 are connected at their free ends by a cross member 76 which includes a concave curve along its length. Again, the cross member includes a spindle 78 connected thereto, including an outer annular groove 80 for accommodating the rope 16 which extends there over (or in an alternate embodiment, there above). The curved configuration of the cross member 76 is shown more clearly in FIG. 7, and FIG. 8 illustrates a top view of the winch drum assembly 60 with rope 16 from the drum extending through the tensioning assembly 66 and guide roller 68.

The cross member 76 is adapted to be biased so that it exerts an upward force on rope 16 extending over the spindle 78 through use of a spring mechanism (not shown). It is to be understood that the rope 16 could equally well be wound in the opposite direction about the drum reel such that it extends under the spindle 78, and the cross member 76 adapted to exert a downward force rather than an upward force. Whether the rope extends from above or below the winch drum reel, or above or below the spindle, or whether the cross member 76 is configured to exert an upward or downward pressure, depends on different factors such as where in the boat the winch is fixed, and so the present invention is not intended to be limited to any one arrangement. Biasing of the arms 72 and 78 could be achieved using any suitable biasing means, however, in preference a spring mechanism (not shown) is used. The present invention is not intended to be limited to any one biasing means either.

The spindle 78 is rotatable about and slideable along the cross member 76 in the same manner as previously described, except because the cross member 76 is not horizontal and now includes a vertical component, more force is required to move the spindle 78 from either end of the cross member 76 towards the highest point at the centre of the cross member 76. The present inventor has found that this configuration addresses the problems associated with the prior art level wind arm arising from the spindle 78 moving back too fast along the cross member at the end of a stroke, before the rope has an opportunity to cleanly form a new layer. In using the level wind arm 10*a* of the present invention, the spindle 78 momentarily pauses after it reaches the end of a stroke before performing a return stroke, because more force is required to cause the spindle to climb the concave slope. This momentary pause is sufficient to enable the rope to rise up when it reaches the end of the winch reel drum and begin a new layer which is consistent with the layer below, resulting in faultless level winding without gaps.

Turning to the tensioning assembly 66 in more detail, it includes a base 81 for mounting above the deck, and a spring biased roller 82, the rope 16 being adapted to extend between the roller 82 and the base 81. The tensioning assembly 66 is configured such that it will not significantly affect release of the rope from the winch drum reel 20, for example, when the anchor is free falling the roller will not prevent the rope from travelling out from the vessel. What it will do however is prevent the rope from travelling in the opposite direction when tension in the rope is lost for any reason. The pressure of the spring biased roller 82 is not so great however to prevent the rope from being wound back onto the winch drum. For example, when the winch assembly is operated to wind the rope and raise the anchor, the winding force is enough to cause the spring biased roller 82 to rise up from the base 81 and allow the rope to be wound about the drum 20 as per normal.

The tensioning assembly 66 is used as a precautionary measure to ensure that tension is always maintained in rope extending out of the winch drum assembly through the level wind arm assembly 10*a*. The tensioning assembly forms yet a further aspect of the present invention. There may be circumstances where tension in the rope is lost after the anchor has been lowered, for example, due to a temporary lack of concentration by the marine vessel operator. In such circumstances, if the tensioning assembly 64 was not present, the rope 16 may gather in the water and lose tension and in some circumstances, the rope around the reel will be caused to rise over the ends and into the clutch mechanism 32.

Figure 10:
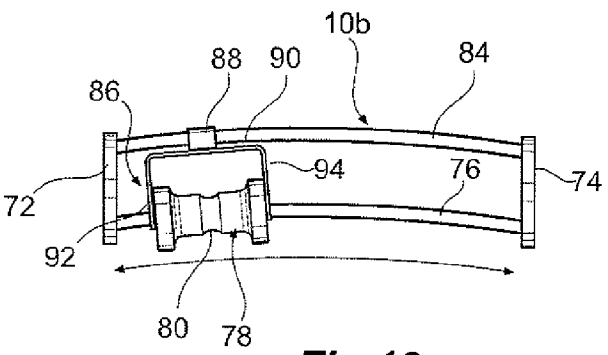
FIG. 10 illustrates an enlarged front view of the level wind arm of the winch assembly of FIG. 9.
Figure 11:
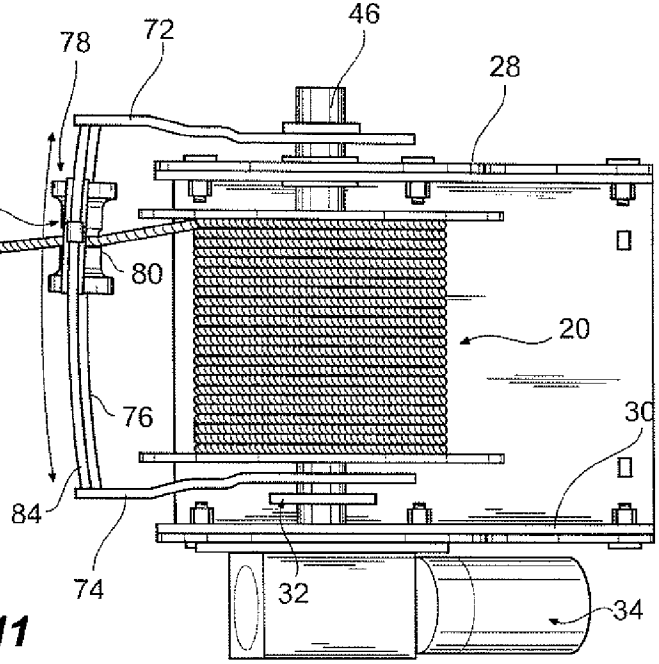
FIG. 11 illustrates a top view of the winch assembly of FIG. 9 including a tensioning assembly and roller.
Figure 9:
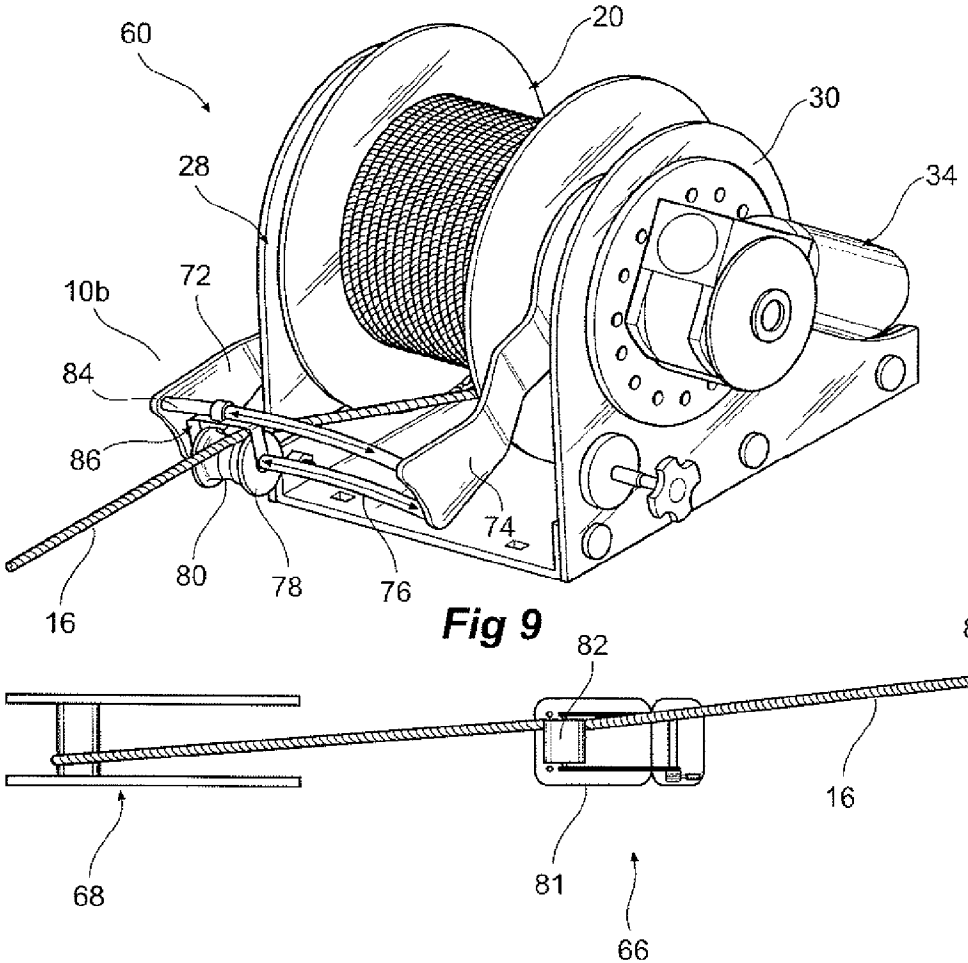
FIG. 9 illustrates a perspective view of the winch assembly of FIG. 3 or FIG. 4 including an improved level wind arm in accordance with a second embodiment of the present invention.

It was with the above problem in mind that embodiments 10*b* and 10*c* have also evolved. The level wind arm assembly 10*b* is shown in FIGS. 9-11 and includes the same features as embodiment 10*a* with some additional elements. In particular, there is a second concave cross member 84 positioned a short distance above cross member 76, the cross members 76 and 84 being substantially identical. A bracket 86 extends between the cross members 76 and 84, and is adapted to slideably engage the upper cross member 84 using a cylinder 88 which journals the cross member 84, and a suspended C-shaped bracket 90 including apertures at the free ends of flange portions 92 and 94 for slideably engaging the lower cross member 76. The flange portions 92 and 94 are spaced apart a sufficient distance to allow for the spindle 78 to be disposed there between.

The skilled addressee would realise that when the spindle 78 is made to move along the cross member 76 by force of the rope, the bracket 86 will move with it. The purpose of the bracket 86 is to ensure that should tension be lost in the rope downstream of the level wind arm 10*b*, the rope 16 will remain inside the bracket 86 preventing it from jumping out of the drum and into the clutch mechanism. The alternate configuration could also be possible, with the spindle 78 being associated with the upper concave cross member 84, the rope extending there under, and the bracket 86 being associated with the lower concave cross member 76.

In accordance with a preferred embodiment of the present invention, level wind arm 10*c* shown in FIGS. 12-14 includes a second spindle 96 associated with the upper concave cross member 84 to thereby enclose the rope 16 between spindles 78 and 96. Two connecting rods 98 and 100 are used on opposed ends of the spindles 78 and 96 to maintain the spindles in vertical alignment, each rod including apertures at ends thereof which slideably engage the cross members 76 and 84.

When the winch drum assembly 60 is positioned below the deck, it is preferable for a further guide assembly 70 to be used as described earlier with reference to FIG. 3. In preference, the further guide assembly is configured in exactly the same way as any one of the level wind arms 10*a*/10*b*/10*c* embodied herein, the only difference being is that it can be fixed to the deck, and not biased. Turning to the preferred embodiment 10*c* for example, it can be appreciated that rope extending out from the wind drum reel 20 extends firstly through the biased level wind arm assembly 10*c*, that is, between spindles 78 and 96, and then upwards towards the guide assembly 70 through another pair of spindles (not shown) configured in exactly the same way and moveable along two spaced apart cross members (not shown).

The skilled addressee would realise that such a guide means is useful when mounting the drum assembly below the deck, because otherwise rope extending directly to the tensioning assembly 66 from down below will not be fed through in a proper manner. The further guide assembly could alternatively be in the form of simply a further roller (not shown).

The advantages of the present invention should now be apparent. In having a cross member that is concave, more force is required for the spindle to "climb" the slope of the cross member causing a momentary pause in motion of the spindle after it reaches the end of wind stroke. This momentary pause allows for rope being wound onto the drum to rise up the end wall of the drum to create a new layer which is aligned and consistent with the layer below, without causing gaps in the rope or other circumstances which could lead to the rope accumulating at any one point, or becoming tangled.

The present invention also includes means of ensuring that tension is maintained in the rope, and that the rope does not jump off the reel and, for example, into the clutch mechanism.

Further advantages and improvements may very well be made to the present invention without deviating from its scope. Although the invention has been shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatus.

In any claims that follow and in the summary of the invention, except where the context requires otherwise due to express language or necessary implication, the word "comprising" is used in the sense of "including", i.e. the features specified may be associated with further features in various embodiments of the invention.

The invention claimed is:

1. A level wind arm for a winch assembly including a winch drum reel rotatable about a central axis of rotation, said level wind arm characterized by:

a first cross member rotatable about an axis extending through or parallel to said central axis of rotation;

a spindle which rotatably engages said first cross member and is slideable therealong, said spindle including receiving means which rotatably contacts a tether extending outwardly from said winch assembly, said first cross member configured to bias against said tether to facilitate level winding of said tether about said winch drum reel; and wherein said first cross member includes a vertical component in the form of a concave curve along its length, said concave curve providing a concave travel path for said spindle whereby travel of said spindle up and along the concave curve of the cross member is resisted by the tether as a result of the cross member being biased in a direction towards a peak of the concave curve, thereby causing said spindle to pause momentarily at the end of each stroke when the spindle is positioned to commence a climb up the concave curve, and thereby facilitating the consistent formation of layers about the winch drum.

2. A level wind arm as characterized in claim 1 wherein said level wind arm includes a second cross member disposed above said first cross member.

3. A level wind arm as characterized in claim 2 wherein said second cross member includes a bracket associated therewith, said bracket slideably engaging both first and second cross members and including flange portions between which said spindle is disposed, wherein movement of said spindle along said first cross member causes said bracket to move along said second cross member.

4. A level wind arm as characterized in claim 3 wherein said bracket defines a perimeter for said tether, thereby preventing said tether from jumping off said winch drum reel.

5. A level wind arm as characterized in claim 2 wherein said second cross member includes a second spindle associated therewith, said second spindle being rotatably associated with said second cross member and slideable therealong, said first and second spindles adapted to move in formation along the respective cross members through use of connecting rods on opposed ends of the spindles including apertures which slideably engage said cross members.

6. A level wind arm as characterized in claim 5 wherein said first and second spindles define a perimeter for said tether, thereby preventing said tether from jumping off said winch drum reel.

7. A winch assembly including a level wind arm as characterized in claim 1.

8. A winch assembly as in claim 7 wherein:

said tether is adapted to be wound about said reel when rotated in a first direction and unwound from said reel when rotated in an opposite direction, said tether including a portion that extends outwardly from said reel to a distal location under tension;

said wind arm being biased against the outwardly extending portion of tether at a point between said reel and said distal location, such force facilitating level winding and unwinding of said tether about said reel.

9. A winch assembly as characterized in claim 8 wherein said level wind arm is disposed a short distance from the reel in a relationship whereby said first cross member extends across the outwardly extending portion of tether.

10. A winch assembly as characterized in claim 8 wherein said reel includes a fixed frame, and said level wind arm is supported between two rotatably biased support arms located on opposed sides of the reel and mounted to said frame, said cross member extending between distal ends of each support arm.

11. A winch assembly as characterized in claim 8 wherein said reel is rotatable through operation of a drive means.

12. A winch assembly as characterized in claim 11 wherein said drive means is in the form of an electric motor capable of forward and reverse drive.

13. A winch assembly as characterized in claim 8 wherein said tether is a rope, chain, cable or similar material capable of withstanding high tensile loads.

14. A winch assembly as characterized in claim 8 wherein said distal location is in the form a guide roller fixed to said boat, used to facilitate movement of said tether in a direction perpendicular to the reel central axis of rotation.

15. A winch assembly as characterized in claim 8 wherein said distal location is in the form of a tensioning assembly characterized by:

a base disposed a spaced apart distance from said winch reel; and a biased roller associated with said base such that rope extending out from said reel extends between the base and the biased roller, said biased roller being configured such that it does not significantly affect release of the rope from the reel, but prevents rope extending from the reel to the tensioning assembly from losing tension until such time that a pulling force is applied in the direction of the winch assembly sufficient to counteract said bias and allow for movement of the rope.

16. A winch assembly as characterized in claim 15 wherein operation of the winch assembly to wind rope thereabout constitutes said sufficient pulling force.

17. A winch assembly as characterized in claim 15 wherein said biased roller is pivotably associated with said base in a direction downwardly and outwardly from the reel.

18. A winch assembly as characterized in claim 8 wherein winch assembly is used for raising and lowering a boat anchor, said outwardly extending portion of tether being tensioned by the weight of the boat anchor.

* * * * *